US008601933B2

(12) United States Patent
Katayama

(10) Patent No.: US 8,601,933 B2
(45) Date of Patent: Dec. 10, 2013

(54) HERMETIC COMPRESSOR AND FRIDGE-FREEZER

(75) Inventor: Makoto Katayama, Shiga (JP)

(73) Assignee: Panasonic Corporation, Osaka (JP)

( * ) Notice: Subject to any disclaimer, the term of this patent is extended or adjusted under 35 U.S.C. 154(b) by 852 days.

(21) Appl. No.: 12/783,055

(22) Filed: May 19, 2010

(65) Prior Publication Data

US 2010/0300142 A1 Dec. 2, 2010

(30) Foreign Application Priority Data

May 26, 2009 (JP) ..... 2009-126079

(51) Int. Cl.
*F25B 39/00* (2006.01)

(52) U.S. Cl.
USPC ..... 92/72

(58) Field of Classification Search
USPC ..... 92/72, 174, 208; 417/415, 902
See application file for complete search history.

(56) References Cited

U.S. PATENT DOCUMENTS

| | | | | |
|---|---|---|---|---|
| 6,928,921 | B2 * | 8/2005 | Brabek | 92/158 |
| 8,210,832 | B2 | 7/2012 | Katayama et al. | |
| 2004/0253131 | A1 * | 12/2004 | Park et al. | 417/902 |
| 2006/0204373 | A1 | 9/2006 | Tsuboi | |
| 2009/0101442 | A1 | 4/2009 | Katayama et al. | |

FOREIGN PATENT DOCUMENTS

| | | | | |
|---|---|---|---|---|
| CN | 1777753 | A | | 5/2006 |
| CN | 1789710 | A | | 6/2006 |
| JP | 04-331874 | A | | 11/1992 |
| JP | 2002-303370 | A | | 10/2002 |
| JP | 2004-169684 | A | | 6/2004 |
| JP | 2006-169998 | A | | 6/2006 |
| JP | 2007-132291 | A | | 5/2007 |
| JP | 2007132291 | A | * | 5/2007 |

* cited by examiner

*Primary Examiner* — Thomas E Lazo
(74) *Attorney, Agent, or Firm* — Brinks Gilson & Lione

(57) ABSTRACT

A hermetic compressor includes an airtight container containing lubricating oil and having a compression element and a motor element. The compression element compresses a refrigerant by being driven by the motor element. The compression element includes a crankshaft extending in a vertical direction and having a main shaft and an eccentric part; a block forming a compression space; a piston having a cylindrical shape and reciprocating in the compression space; and a connecting rod for transmitting the rotation of the eccentric part to the piston. The piston has its center of gravity on either the upper side or the lower side in the vertical direction with respect to a plane which passes through the central axis of the piston and is perpendicular to the crankshaft.

10 Claims, 10 Drawing Sheets

HERMETIC COMPRESSOR AND FRIDGE-FREEZER

RELATED APPLICATIONS

This application claims priority under 35 U.S.C. §119 to Japanese Patent Application No. 2009-126079 filed on May 26, 2009, the entire content of which is hereby incorporated by reference.

BACKGROUND OF THE INVENTION

1. Field of the Invention

The present invention relates to hermetic compressors and refrigerating-freezing devices.

2. Background Art

In recent years, hermetic compressors used in freezer devices such as domestic fridge-freezers are strongly desired to have low electric power consumption. This type of conventional hermetic compressor provides high volumetric efficiency by making the outer shape of the piston unique so as to reduce the sliding loss between the piston and the cylinder. One such example is disclosed in Japanese Patent Unexamined Publication No. 2004-169684.

The above-mentioned conventional hermetic compressor will be described as follows with reference to drawings. FIG. 9 is a longitudinal sectional view of the conventional hermetic compressor, and FIG. 10 is a perspective view of a piston in the hermetic compressor.

As shown in FIGS. 9 and 10, the hermetic compressor includes airtight container 1 having motor element 4 and compression element 5 driven thereby, which are suspended by a plurality of springs 25. Motor element 4 includes stator 2 and rotor 3. Airtight container 1 contains oil 6 at its bottom.

Compression element 5 includes crankshaft 10 having main shaft 11 and eccentric part 12 eccentric to main shaft 11. Main shaft 11 has rotor 3 fixedly fitted thereto, and an oil pump (not shown) having an opening in oil 6.

Compression element 5 further includes block 20 above motor element 4. Block 20 has substantially cylindrical cylinder 21 and bearing 22 for supporting main shaft 11. Compression element 5 further includes piston 30, which is reciprocably inserted in cylinder 21 and connected to eccentric part 12 via connection means 41.

Piston 30, which is composed of top end surface 31, skirt end surface 32, and outer peripheral surface 33, has piston pin bore 38 parallel to main shaft 11. Piston pin 36 is inserted through piston pin bore 38 and connected to connection means 41.

The hermetic compressor having the above-described structure operates as follows.

When supplied with electric power, motor element 4 rotates rotor 3, and hence, crankshaft 10. At this moment, the eccentric rotation of eccentric part 12 of crankshaft 10 is transmitted to piston 30 via connection means 41, making piston 30 reciprocate in cylinder 21.

With the reciprocation of piston 30, refrigerant gas 40 in airtight container 1 is suctioned into intake muffler 45 and then into cylinder 21. At the same time, low-pressure refrigerant gas 40 is drawn into airtight container 1 through a cooling system (not shown). Refrigerant gas 40 suctioned into cylinder 21 is compressed, and discharged again to the cooling system.

When the hermetic compressor is in operation, piston 30 reciprocates in cylinder 21. As a result, oil 6 pumped up by the oil pump is supplied to the sliding part between cylinder 21 and outer peripheral surface 33 of piston 30, thereby lubricating and sealing the sliding part.

In the above-described conventional structure, however, when piston 30 moves from the bottom dead center to the top dead center in the compression stroke, top end surface 31 of piston 30 is subjected to the compressive load of the refrigerant. This causes crankshaft 10 to be pushed strongly in the direction opposite to piston 30 via connection means 41, and then to be bent. As a result, piston 30 is greatly inclined in the vertical direction, without becoming posturally stable.

Moreover, in the above-described conventional structure, the vertical inclination of piston 30 with respect to cylinder 21 can be controlled only between the end of top end surface 31 and the end of skirt end surface 32 by the clearance between outer peripheral surface 33 of piston 30 and cylinder 21.

As a result, piston 30 is greatly inclined, increasing the clearance between outer peripheral surface 33 of piston 30 and cylinder 21, and hence causing more refrigerant to leak from the top-dead-center side to the bottom-dead-center side of piston 30 and then through the clearance. This results in a reduction in the refrigeration capacity of the compressor.

Such a reduction in the refrigeration capacity increases the sliding loss particularly in a slow rotation of 23 rps or so, thereby decreasing the volumetric efficiency of the compressor, and hence increasing the electric power consumption of the refrigeration cycle.

In the case of using a refrigerant R600a, piston 30 is required to have a large outer diameter. This makes the refrigerant leak more easily and increases inclination fluctuation of piston 30 in the vertical direction, causing the sliding loss due to vibration and collision, thereby remarkably decreasing the volumetric efficiency. The term "inclination fluctuation" of piston 30" means that piston 30 is posturally unstable because crankshaft 10 is bent as a result of top end surface 31 of piston 30 being subjected to the compressive load of the refrigerant.

SUMMARY OF THE INVENTION

The present invention, which has been developed to solve the aforementioned conventional problems, has an object of providing a hermetic compressor having high reliability, high refrigeration capacity, and high volumetric efficiency.

The hermetic compressor of the present invention includes an airtight container containing lubricating oil and having a compression element and a motor element. The compression element compresses a refrigerant by being driven by the motor element. The compression element includes a crankshaft extending in a vertical direction and having a main shaft and an eccentric part; a block forming a compression space; a piston having a cylindrical shape and reciprocating in the compression space; and a connecting rod for transmitting the rotation of the eccentric part to the piston. The piston has its center of gravity on either the upper side or the lower side in the vertical direction with respect to a plane which passes through the central axis of the piston and is perpendicular to the crankshaft.

This hermetic compressor reduces sliding loss and abrasion due to local sliding by preventing the unstable behavior of the piston, and also reduces a decrease in the volumetric efficiency, thereby having high reliability.

DETAILED DESCRIPTION OF THE PREFERRED EMBODIMENTS

The embodiment of the present invention will be described as follows with reference to drawings.

Figure 1:
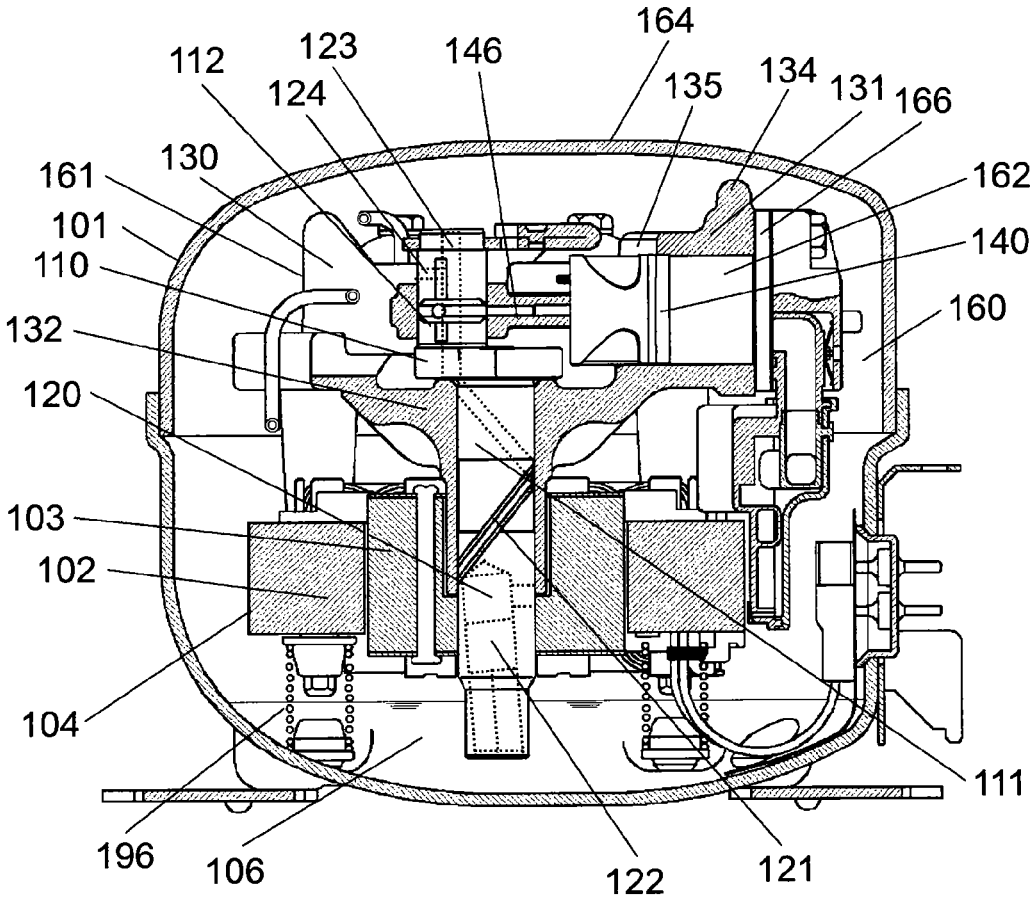
FIG. 1 is a longitudinal sectional view of a hermetic compressor according to an embodiment of the present invention.
Figure 2:
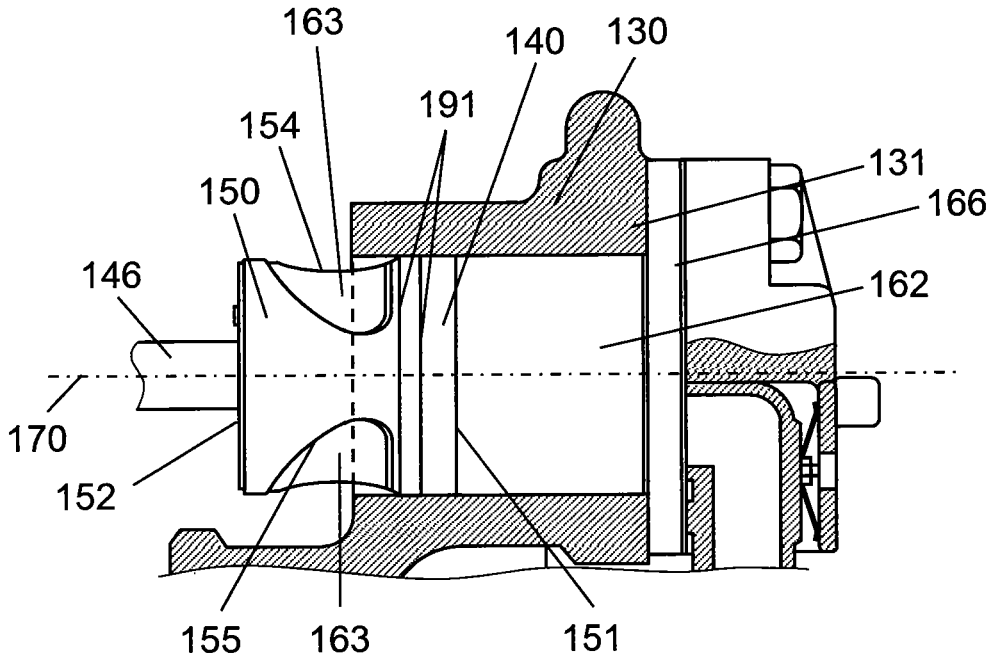
FIG. 2 is an enlarged view of components around a piston in the hermetic compressor.
Figure 3:
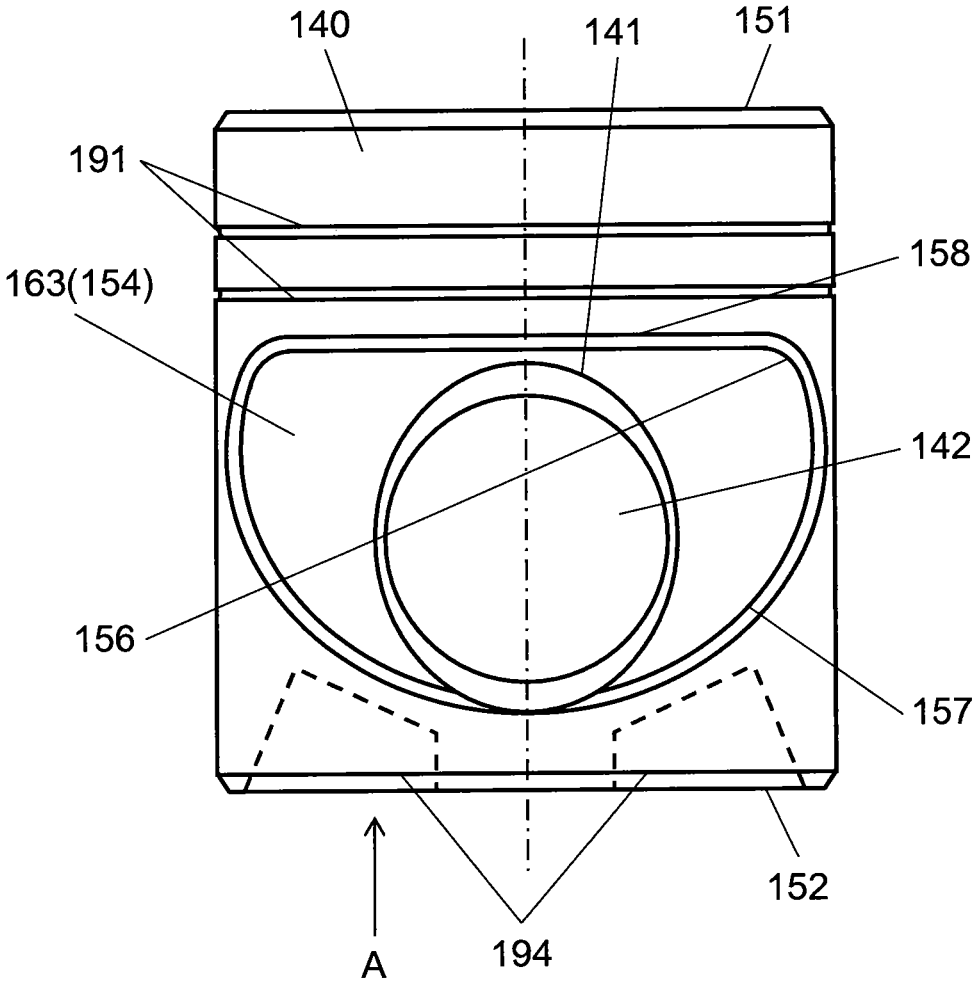
FIG. 3 is a top view of the piston in the hermetic compressor.
Figure 4:
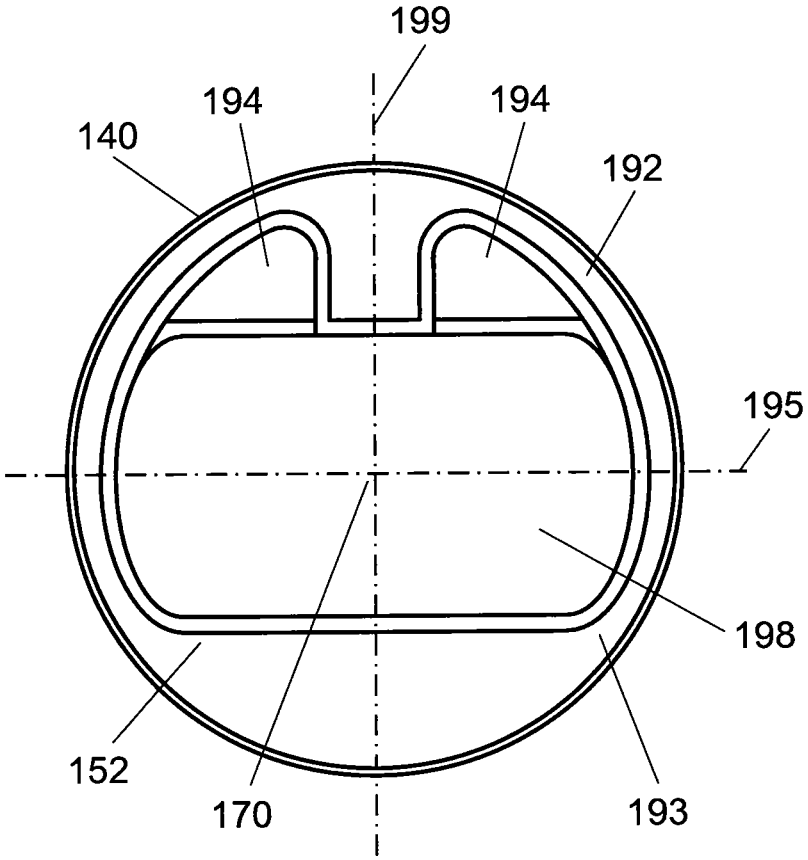
FIG. 4 is a view taken along a direction "A" of FIG. 3.

FIG. 1 is a longitudinal sectional view of hermetic compressor 164 according to an embodiment of the present invention. FIG. 2 is an enlarged view of components around a piston in hermetic compressor 164. FIG. 3 is a top view of the piston. FIG. 4 is a view taken along a direction "A" of FIG. 3.

Figure 5:
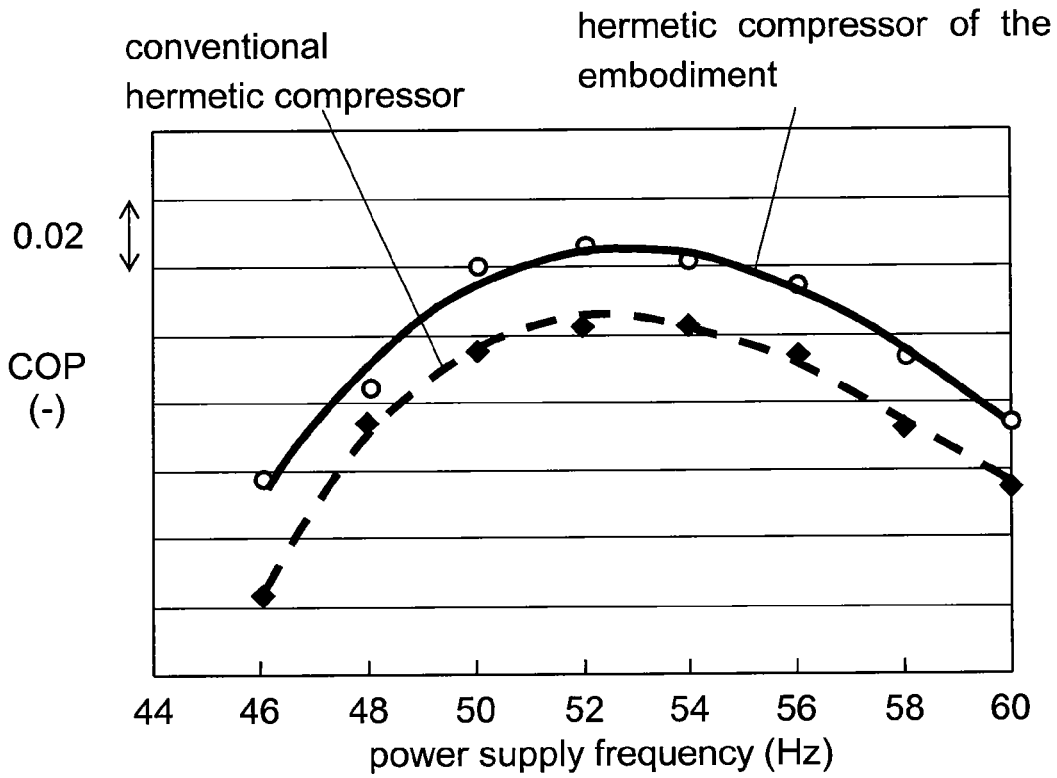
FIG. 5 is a characteristic diagram of the hermetic compressor according to the embodiment of the present invention.

FIG. 5 is a characteristic diagram of hermetic compressor 164. The horizontal axis represents the power supply frequency, which is substantially equal to the rotational speed of hermetic compressor 164 and the vertical axis represents the COP (coefficient of performance) indicating volumetric efficiency.

As shown in FIGS. 1 to 4, hermetic compressor 164 includes airtight container 101 having motor element 104 and compression element 161, and also containing oil 106, which is lubricating oil. Motor element 104, which includes stator 102 and rotor 103, is inverter-driven at a plurality of operation frequencies including an operation frequency that is equal to or lower than the power supply frequency. Compression element 161 is driven by and arranged above motor element 104. Compression element 161 includes crankshaft 110, block 130, piston 140, and connecting rod 146.

In the embodiment, hermetic compressor 164 uses refrigerant 160, which is a hydrocarbon system refrigerant R600a having a low global warming potential.

Crankshaft 110 extending substantially vertically includes main shaft 111 to which rotor 103 is fixedly fitted, and eccentric part 112 eccentric to main shaft 111.

Hermetic compressor 164 further includes lubrication means 120, which is composed of centrifugal pump 122, viscosity pump 121, longitudinal hole 123, and lateral hole 124. Centrifugal pump 122 is arranged at the bottom of crankshaft 110 and has an opening in oil 106. Viscosity pump 121 is communicated at one end thereof with centrifugal pump 122 on the outer periphery of main shaft 111, and is spirally arranged in the top of main shaft 111 at the other end. Longitudinal hole 123 is arranged above viscosity pump 121 and its top end is open to the space in airtight container 101. Longitudinal hole 123 extends in the axial direction of main shaft 111 so that oil 106 can flow from viscosity pump 121. Lateral hole 124 extends from a point in longitudinal hole 123 in eccentric part 112 and is open to the outer peripheral surface of eccentric part 112.

Block 130 includes cylinder 131 and main bearing 132. Cylinder 131 is a component of compression space 162, and main bearing 132 supports main shaft 111. Block 130 further includes curved bump part 134 in the top of cylinder 131.

Piston 140 having a cylindrical shape is reciprocably inserted in cylinder 131 of block 130. Connecting rod 146 is a connection mechanism for transmitting the rotation of eccentric part 112 to piston 140. One end of connecting rod 146 is connected to eccentric part 112, and the other end is connected to piston 140 via piston pin 142, which is fixedly inserted in piston pin bore 141.

Piston 140 includes cavity 198, which is open to skirt end surface 152 thereof. The other end of connecting rod 146 is inserted into cavity 198 so as to be connected to piston 140 by piston pin 142.

Substantially cylindrical compression space 162 is composed of cylinder 131, piston 140 reciprocably inserted in cylinder 131, and valve plate 166 arranged on the end face of cylinder 131.

Piston 140 is divided into upper side in the vertical direction 192 and lower side in the vertical direction 193 with respect to plane 195, which passes through central axis 170 of piston 140 and is perpendicular to crankshaft 110.

Piston 140 is provided on its outer peripheral surface 150 with concavely recessed portion 163, which is recessed radially inwardly. Concavely recessed portion 163 includes first concavely recessed portion 154 on upper side in the vertical direction 192 and second concavely recessed portion 155 on lower side in the vertical direction 193. First and second concavely recessed portions 154 and 155 are equal in volume.

Concavely recessed portion 163 is communicated with neither top end surface 151 nor skirt end surface 152 of piston 140. When developed into a plane, concavely recessed portion 163 has a contour which does not form a line parallel with central axis 170 of piston 140.

In FIG. 1, piston 140 is in the bottom dead center position. As apparent from FIG. 1, when piston 140 is near the bottom dead center, piston 140 on the skirt-end-surface 152 side is partially exposed from cylinder 131 of block 130 to the space in airtight container 101.

It is also apparent from FIG. 1 that when piston 140 is near the bottom dead center, both first and second concavely recessed portions 154 and 155 of concavely recessed portion 163 are partially exposed from cylinder 131 of block 130 to the space in airtight container 101.

The following is a description of the shapes of first and second concavely recessed portions 154 and 155 of concavely recessed portion 163.

Piston 140 is provided on the skirt-end-surface 152 side with overhanging part 157, which is connected with substantially linear edge part 158 on the top-end-surface 151 side of piston 140 via R-shaped connection part 156. Overhanging part 157 has a curvature smaller than R-shaped connection part 156.

Piston 140 includes bilaterally-symmetric hollow parts 194 on upper side in the vertical direction 192. Hollow parts 194 are depressed from skirt end surface 152 toward top end surface 151.

Providing hollow parts 194 on upper side in the vertical direction 192 allows piston 140 to have less weight on upper side in the vertical direction 192 than on lower side in the vertical direction 193 by 0.5% to 5% of the total weight of piston 140. As a result, piston 140, which is made of a single material such as aluminum or iron, has its center of gravity on lower side in the vertical direction 193.

Hermetic compressor 164 having the above-described structure operates as follows.

Rotor 103 of motor element 104 rotates crankshaft 110. The rotation of eccentric part 112 of crankshaft 110 is transmitted to piston 140 via connecting rod 146 and piston pin 142, allowing piston 140 to reciprocate in cylinder 131.

As a result, refrigerant 160 is suctioned from a cooling system (not shown) into compression space 162 to be compressed, and discharged again to the cooling system.

The test results shown in FIG. 5 indicate that the hermetic compressor according to the present embodiment has a higher volumetric efficiency than the conventional hermetic compressor, regardless of the rotational speed.

It has been confirmed that the high volumetric efficiency is particularly evident when piston 140 has less weight on upper side in the vertical direction 192 than on lower side in the vertical direction 193 by 0.5% to 5% of the total weight of piston 140.

The reason for the high volumetric efficiency is considered as follows.

While piston 140 is horizontally reciprocating in compression space 162, the position of the center of gravity shifts downward in the vertical direction. This causes piston 140 to be subjected to different inertial forces between upper side in the vertical direction 192 and lower side in the vertical direction 193 and then to get out of balance. As a result, the skirt-end-surface 152 side and the top-end-surface 151 side of piston 140 may shift downward and upward, respectively, or may alternatively shift upward and downward, respectively, in the vertical direction in cylinder 131. Thus, piston 140 is considered either to be sliding or to be likely to be sliding obliquely upward and downward in the vertical direction.

The oblique sliding of piston 140 causes the clearance between compression space 162 and piston 140 to be filled with oil 106, making the outer periphery of piston 140 pressed by the film of oil 106. Oil 106 existing on a large-clearance side (the top-dead-center side) in the direction of movement of piston 140 begins to increase its film thickness on a small-clearance side (the bottom-dead-center side) with the movement of piston 140 due to the so-called "wedge effect".

At the end of the bottom dead center, on the other hand, piston 140 is pressed to reduce the clearance by the wedge effect. The clearance is filled with oil 106, which acts on preventing the reduction in the clearance. Thus, compression space 162 is subjected to the so-called squeeze effect which makes oil 106 have a film thickness that is well balanced with the pressure due to the wedge effect.

In short, the oblique sliding of piston 140 increases the wedge and squeeze effects of the film of oil 106. As a result, the sliding between piston 140 and the inner wall surface of cylinder 131 as a component of compression space 162 increases the oil-film pressure, providing a lubrication state in which piston 140 can stably reciprocate. This is considered to result in a reduction in the sliding loss.

Piston 140 is made of a single material in the embodiment, but may alternatively be made using different metals between upper side in the vertical direction 192 and lower side in the vertical direction 193, and have its center of gravity on either side of them.

More specifically, the center of gravity of piston 140 is changed by embedding, press-fitting, or screwing different metals having similar coefficients of thermal expansion and different specific gravities from each other. As a result, piston 140 can be prevented from being deformed due to the temperature change during the operation of hermetic compressor 164. This solves problems such as an increase in the sliding loss due to the deformation of piston 140 or a decrease in the volumetric efficiency due to the refrigerant leakage between piston 140 and cylinder 131.

In the embodiment of the present invention, piston 140 has a changing center of gravity and a similar coefficient of thermal expansion to cylinder 131, making clearance therebetween substantially uniform, regardless of the thermal expansion. Furthermore, it becomes unnecessary to provide an extremely inefficient control in production, that is, size control according to the thermal expansion during the assembly process, thereby improving productivity.

The following is a description of the weights of hollow parts 194 of piston 140.

As described earlier in the structure of piston 140, it has been confirmed that the high volumetric efficiency is particularly evident when piston 140 has less weight on upper side in the vertical direction 192 than on lower side in the vertical direction 193 by 0.5% to 5% of the total weight of piston 140.

When the difference in weight of piston 140 between upper side in the vertical direction 192 and lower side in the vertical direction 193 is less than 0.5% of the total weight of piston 140, the volumetric efficiency is small probably because of the following reason. The squeeze and wedge effects of the film of oil 106 are not high enough to sufficiently reduce the sliding loss.

When the difference in weight of piston 140 between upper side in the vertical direction 192 and lower side in the vertical direction 193 is over 5% of the total weight of piston 140, the volumetric efficiency is also small probably because of the following reason. The oblique sliding of piston 140 locally increases the coefficient of friction in the sliding between piston 140 and cylinder 131, and the coefficient of friction compensates the wedge and squeeze effects of oil 106.

Lubrication means 120, on the other hand, makes centrifugal pump 122 pump up oil 106 by the centrifugal force generated by its rotation along with crankshaft 110. When oil 106 reaches viscosity pump 121, lubrication means 120 makes viscosity pump 121 pump up oil 106, and spray it through longitudinal and lateral holes 123 and 124 into airtight container 101.

Oil 106 thus sprayed hits bump part 134, and drops onto and adheres to outer peripheral surface 150 of piston 140 from above via notch 135. When piston 140 is in the bottom dead center position, piston 140 is supposed to be partially exposed, including concavely recessed portion 163, from block 130. This allows concavely recessed portion 163 to be directly supplied with sufficient amount of oil 106 from above via notch 135.

Oil 106 thus dropped onto and adhered to outer peripheral surface 150 is supplied to annular grooves 191 and outer peripheral surface 150 other than concavely recessed portion 163 along with the reciprocation of piston 140, thereby lubricating between outer peripheral surface 150 and cylinder 131.

Oil 106 is effectively drawn between cylinder 131 and outer peripheral surface 150 particularly when piston 140 moves from the bottom dead center to the top dead center.

When developed into a plane, concavely recessed portion 163 form a curve that increases the slide width toward the skirt of piston 140 so as not to form a line parallel with central axis 170 of piston 140. As a result, oil 106 drawn into concavely recessed portion 163 is transmitted close to substantially linear edge part 158 of concavely recessed portion 163 on the top-end-surface 151 side and is kept there, and is also transmitted and kept in annular grooves 191.

Consequently, a sufficient amount of oil 106 is supplied to the sliding part between cylinder 131 and piston 140, and is held in an excellent condition.

As a result, a sufficient amount of oil film is maintained between cylinder 131 and outer peripheral surface 150 so as to ensure the sealing therebetween so as to improve the volumetric efficiency, and hence the refrigeration capacity.

As described above, concavely recessed portion 163 does not form a line parallel with central axis 170 of piston 140 when developed into a plane. This allows the prevention of local abrasion, for example, in the direction of reciprocation, which occurs when concavely recessed portion 163 forms a line parallel with central axis 170 of piston 140. The combination between the feature of preventing local abrasion and the excellent lubrication of piston 140 increases the reliability of the hermetic compressor of the present invention.

In the embodiment, hollow parts 194 depressed from skirt end surface 152 toward top end surface 151 are formed bilaterally-symmetric on upper side in the vertical direction 192. It has been confirmed from experiments, however, that the volumetric efficiency can also be improved when piston 140 is arranged below motor element 104, and hollow parts 194 are arranged on lower side in the vertical direction 193.

The technique for improving the lubrication of piston 140 and the technique for improving the volumetric efficiency to locate the center of gravity of piston 140 on either the upper side or the lower side in the vertical direction both contribute to an improvement in the volumetric efficiency of compressor 164. These techniques, however, are combined and produce a synergistic effect, improving the volumetric efficiency of compressor 164, as compared with in the conventional hermetic compressor.

When hermetic compressor 164 is operated at a rotational speed of 23 rps or less, the ratio of the fixed loss to the total loss is large. Sliding loss and vibration can be reduced particularly effectively when hermetic compressor 164 is operated at a low rotational speed at which the electric power consumption can be reduced effectively.

The refrigerant R600a has a smaller density than a refrigerant R134a, which is conventionally used in refrigerators. Therefore, to obtain the same refrigeration capacity as using the refrigerant R134a, hermetic compressor 164 using refrigerant R600a requires a larger cubic capacity and piston 140 having a larger outer diameter.

This structure causes a passage through which refrigerant 160 leaks in airtight container 101 via the clearance between cylinder 131 and piston 140 to have a larger cross section, making refrigerant 160 more likely to leak.

In the invention, however, the technique for improving the lubrication of piston 140 improves the lubrication of the sliding part between piston 140 and cylinder 131, thereby improving the sealing effect for the clearance between cylinder 131 and piston 140. As a result, even when the outer diameter of piston 140 is increased by the use of refrigerant R600a, refrigerant 160 is effectively prevented from leaking.

A freezer device, which is mounted with hermetic compressor 164 having a high volumetric efficiency, can have low power consumption.

The center of gravity of piston 140 is located on lower side in the vertical direction 193 by providing hollow parts 194 on upper side in the vertical direction 192 of piston 140. Instead of providing hollow parts 194, however, first concavely recessed portion 154 can be made larger in volume than second concavely recessed portion 155. Alternatively, it is possible to locate the center of gravity of piston 140 on upper side in the vertical direction 192 by making first concavely recessed portion 154 smaller in volume than second concavely recessed portion 155.

It is also possible to make upper side in the vertical direction 192 and lower side in the vertical direction 193 of piston 140 different from each other in volume without providing any of hollow parts 194 or first concavely recessed portion 154 or second concavely recessed portion 155. This can be achieved, for example, by making piston 140 using different metals that are partially different from each other to an extent not to affect the change in the clearance between piston 140 and the inner wall surface of cylinder 131 as a component of compression space 162 while hermetic compressor 164 is in operation.

As described above, the center of gravity piston 140 can be changed either to upper side in the vertical direction 192 or to lower side in the vertical direction 193. This structure has been confirmed to improve the volumetric efficiency when hermetic compressor 164 is in operation, and there are a large number of ways to achieve this structure.

Figure 6:
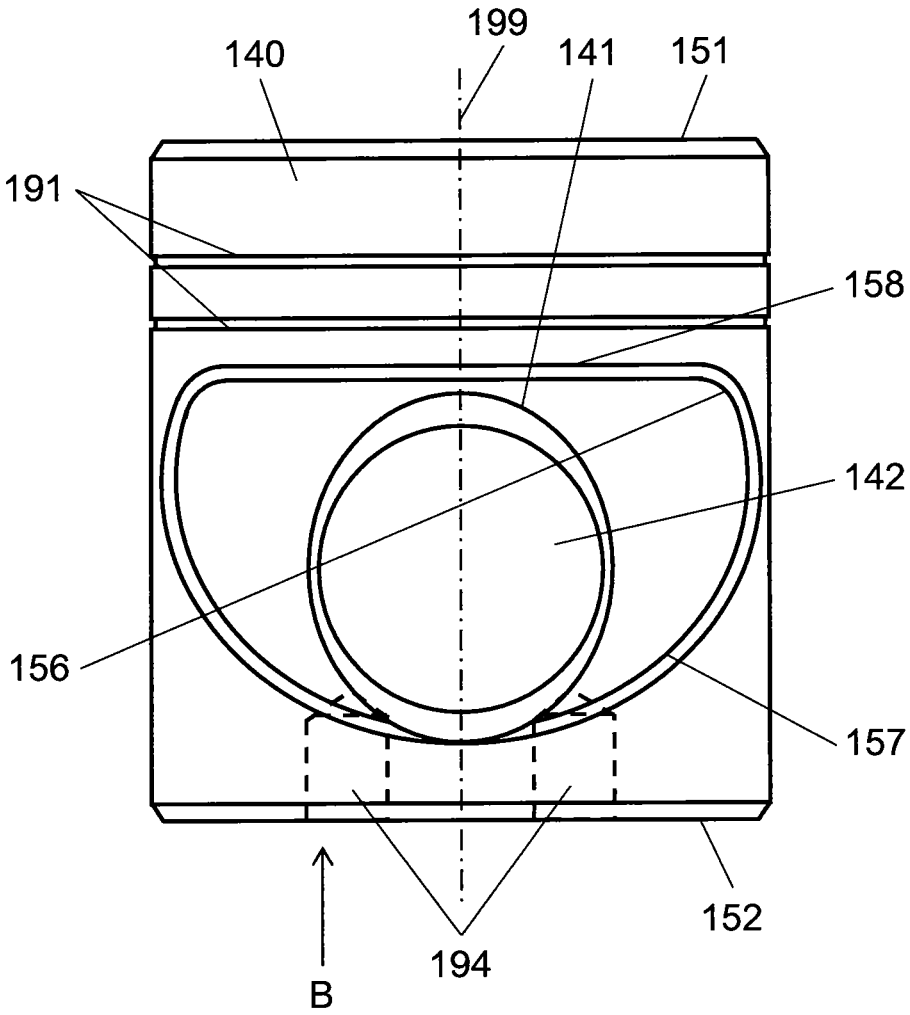
FIG. 6 is a top view of another example of the piston in the hermetic compressor.
Figure 7:
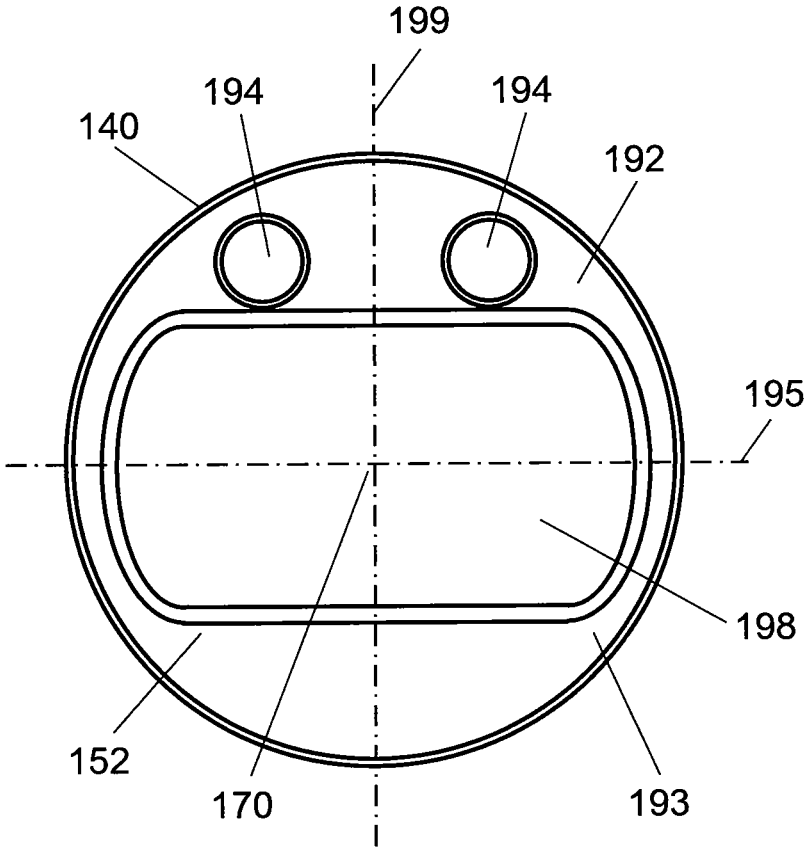
FIG. 7 is a view taken along a direction "B" of FIG. 6.

Hollow parts 194, which are shown in FIGS. 3 and 4, may alternatively be formed as shown in FIGS. 6 and 7. FIG. 6 is a top view of another example of piston 140 in hermetic compressor 164. FIG. 7 is a view taken along a direction "B" of FIG. 6.

In FIGS. 6 and 7, hollow parts 194 are holes extending from skirt end surface 152 to top end surface 151 of piston 140. Hollow parts 194 are formed on upper side in the vertical direction 192 in such a manner as to be symmetrical to each other with respect to vertical plane 199, which passes through central axis 170 of piston 140. Of course, hollow parts 194 may alternatively be arranged on lower side in the vertical direction 193.

Compression element 161 is arranged above motor element 104 in the embodiment, but may alternatively be arranged below it. In terms of vibration, however, it is preferable to arrange compression element 161 above motor element 104 so as to reduce the vibration transmission from compression element 161, which is the vibration source, to airtight container 101 via springs 196.

Figure 8:
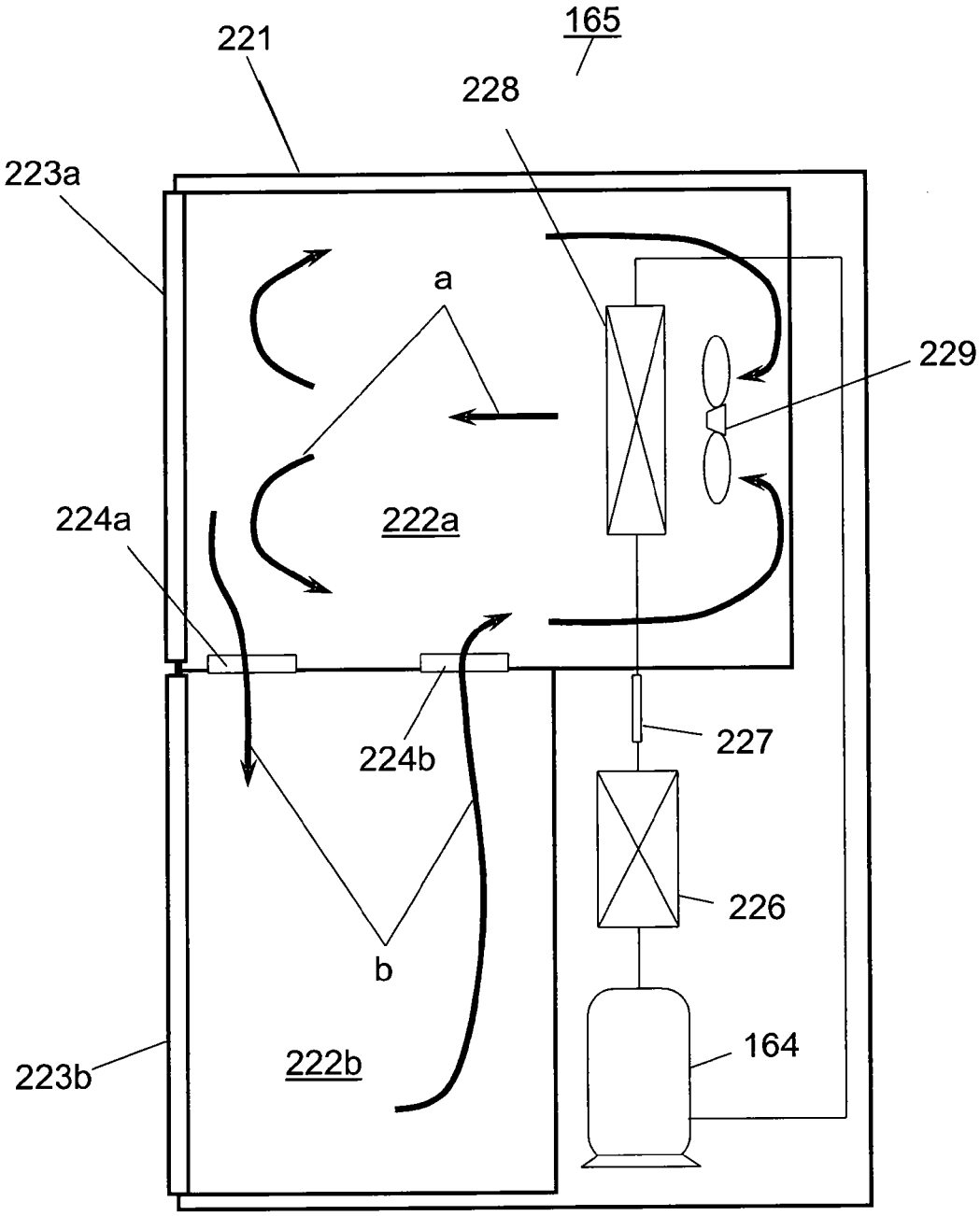
FIG. 8 is a schematic diagram of a refrigerating-freezing device of the embodiment of the present invention.
Figure 9:
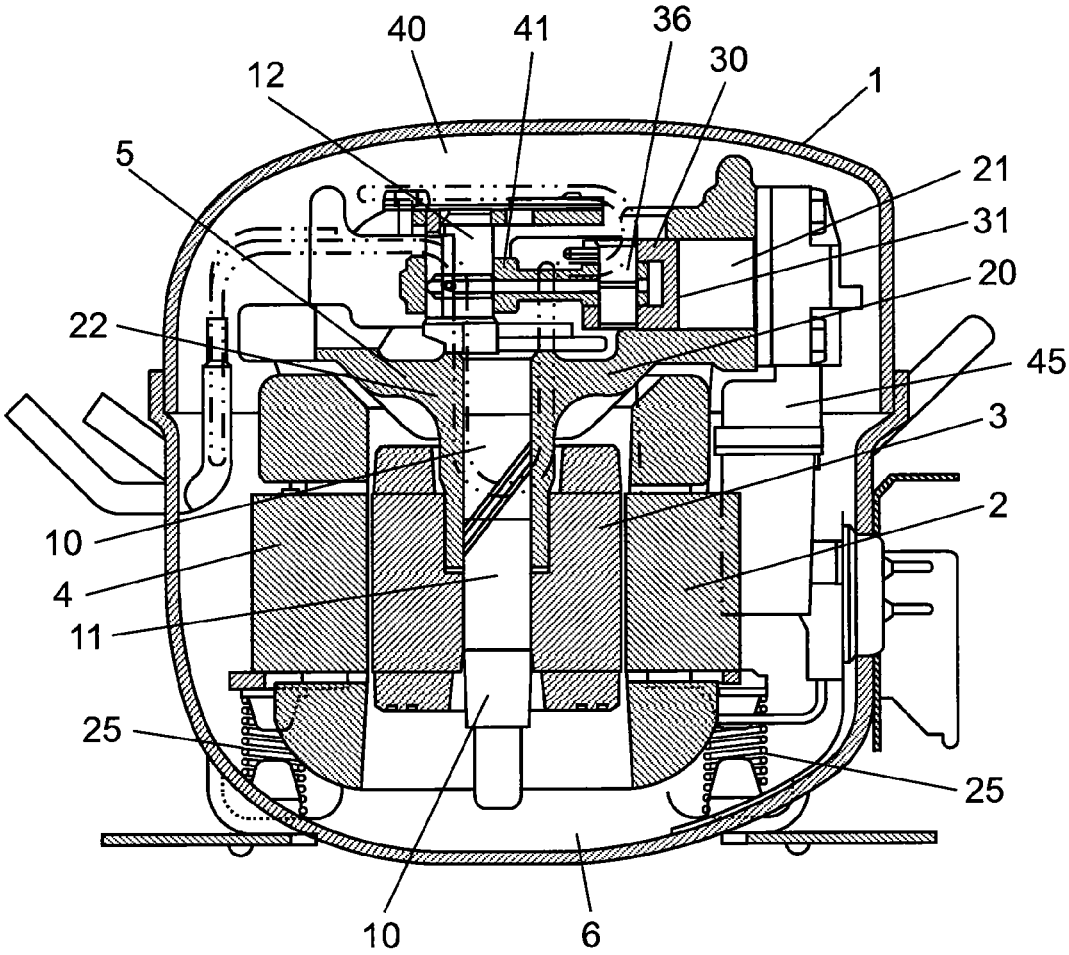
FIG. 9 PRIOR ART
FIG. 9 is a longitudinal sectional view of a conventional hermetic compressor.
Figure 10:
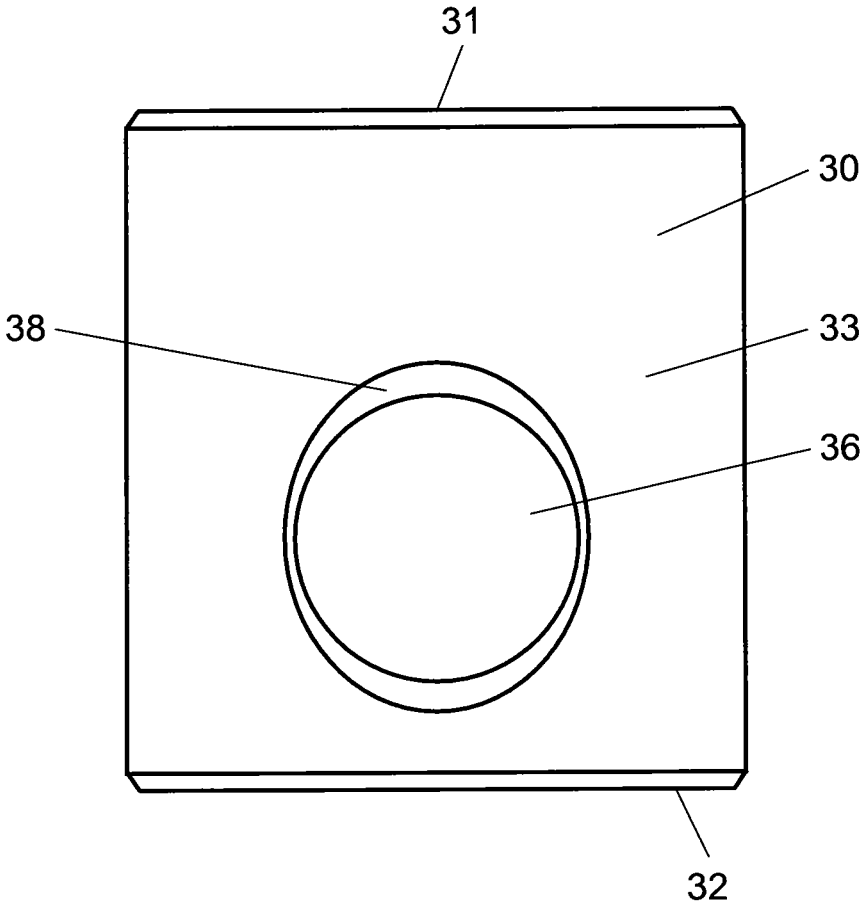
FIG. 10 PRIOR ART
FIG. 10 is a perspective view of a piston in the conventional hermetic compressor.

FIG. 8 is a schematic diagram of refrigerating-freezing device 165 of the embodiment of the present invention. Refrigerating-freezing device 165, which is, for example, a domestic electric refrigerator, can have low electric power consumption by mounting hermetic compressor 164 thereon.

In FIG. 8, refrigerating-freezing device 165 includes device body 221 having first storage room 222*a* with first door 223*a* and second storage room 222*b* with second door 223*b*. First and second storage rooms 222*a* and 222*b* have an open front and are covered with thermal insulating material. First and second doors 223*a* and 223*b* have insulating characteristics and are used to open and close first and second storage rooms 222*a* and 222*b*, respectively. First and second storage rooms 222*a* and 222*b* are communicated with each other via passages 224*a* and 224*b*.

Device body 221 further includes a refrigeration cycle having hermetic compressor 164, condenser 226, decompressor 227, and evaporator 228, which are connected in a loop through piping. Evaporator 228 is arranged in first storage room 222*a*. First storage room 222*a* includes fan 229, which circulates the air cooled by evaporator 228 as shown by the arrows "a" in first storage room 222*a*. Second storage room 222*b* is cooled by part of the cool air drawn thereinto from first storage room 222*a* via passages 224*a* and 224*b* as shown by the arrows "b".

As described above, refrigerating-freezing device 165 can perform efficient cooling operation, and hence, have a low power electric consumption by mounting efficient hermetic compressor 164 thereon.

What is claimed is:

1. A hermetic compressor, comprising:

an airtight container having a compression element and a motor element, the compression element being configured to be driven by the motor element for compressing a refrigerant, the compression element including:

a crankshaft extending in a vertical direction, the crankshaft having a main shaft and an eccentric part;

a block forming a compression space;

a piston having a cylindrical shape, the piston reciprocating in the compression space; and a connecting rod for transmitting rotation of the eccentric part to the piston, wherein the piston has a center of gravity on one of an upper side and a lower side in the vertical direction with respect to a plane, the plane passing through a central axis of the piston and being perpendicular to the crankshaft, and the upper side and the lower side in the vertical direction of the piston are different from each other in volume, and the piston is provided on an outer peripheral surface thereof with a concavely recessed portion recessed radially inwardly, the concavely recessed portion including a first concavely recessed portion on the upper side in the vertical direction and a second concavely recessed portion on the lower side in the vertical direction, the first concavely recessed portion and the second concavely recessed portion being different from each other in volume.

2. The hermetic compressor of claim 1, wherein the compression element is arranged above the motor element; and the center of gravity of the piston is in the lower side in the vertical direction.

3. The hermetic compressor of claim 1, wherein the piston has less weight on the upper side than on the lower side in the vertical direction by 0.5% to 5% of a total weight of the piston.

4. The hermetic compressor of claim 1, wherein the concavely recessed portion is formed to be partially exposed from the block when the piston is near a bottom dead center.

5. The hermetic compressor of claim 1, wherein the motor element includes a rotor operable to drive the crankshaft of the compression element at a rotational speed of not more than 23 rps.

6. The hermetic compressor of claim 1, wherein the refrigerant is a hydrocarbon system refrigerant R600a.

7. The hermetic compressor of claim 1, wherein the compression element compresses a refrigerant from a refrigerating-freezing device.

8. A hermetic compressor, comprising:

an airtight container having a compression element and a motor element, the compression element being configured to be driven by the motor element for compressing a refrigerant, the compression element including:

a crankshaft extending in a vertical direction, the crankshaft having a main shaft and an eccentric part;

a block forming a compression space;

a piston having a cylindrical shape, the piston reciprocating in the compression space; and a connecting rod for transmitting rotation of the eccentric part to the piston, wherein the piston has a center of gravity on one of an upper side and a lower side in the vertical direction with respect to a plane, the plane passing through a central axis of the piston and being perpendicular to the crankshaft, a length of the upper side face of the piston is equal to a length of the lower side face of the piston in the central axis direction of the piston, and the piston is configured to slide in the compression space obliquely upward and downward in the vertical direction.

9. A hermetic compressor, comprising:

an airtight container having a compression element and a motor element, the compression element being configured to be driven by the motor element for compressing a refrigerant, the compression element including:

a crankshaft extending in a vertical direction, the crankshaft having a main shaft and an eccentric part;

a block forming a compression space;

a piston having a cylindrical shape, the piston reciprocating in the compression space; and a connecting rod for transmitting rotation of the eccentric part to the piston, wherein the piston has a center of gravity on one of an upper side and a lower side in the vertical direction with respect to a plane, the plane passing through a central axis of the piston and being perpendicular to the crankshaft, and the piston is provided with a hollow part on one of the upper side and the lower side, the hollow part being depressed from a skirt end surface toward a top end surface.

10. The hermetic compressor of claim 9, wherein the compression element is arranged above the motor element, and the center of gravity of the piston is in the lower side in the vertical direction.

* * * * *